US007261296B1

(12) United States Patent
Duncan

(10) Patent No.: US 7,261,296 B1
(45) Date of Patent: Aug. 28, 2007

(54) AUTO RACING BOARD GAME

(76) Inventor: Raymond Duncan, 607 Danner Rd., South Charleston, WV (US) 25303

( * ) Notice: Subject to any disclaimer, the term of this patent is extended or adjusted under 35 U.S.C. 154(b) by 20 days.

(21) Appl. No.: 11/189,574

(22) Filed: Jul. 26, 2005

(51) Int. Cl.
*A63F 3/00* (2006.01)

(52) U.S. Cl. ..... 273/246; 273/277

(58) Field of Classification Search ..... 273/246, 273/243, 244, 259, 277
See application file for complete search history.

(56) References Cited

U.S. PATENT DOCUMENTS 3,940,863 A * 3/1976 Kritzberg ..... 434/236
5,114,152 A 5/1992 Rouse et al.
5,308,078 A 5/1994 Hatter
5,322,293 A 6/1994 Goyette
5,551,698 A 9/1996 Lyon
5,560,609 A 10/1996 Grant
5,749,582 A 5/1998 Fritz et al.
5,934,673 A 8/1999 Telarico et al.
6,095,522 A 8/2000 Spell et al.
6,464,223 B2 10/2002 Rutter
6,471,209 B1 * 10/2002 Barshinger ..... 273/246
6,764,076 B2 7/2004 Merritt

* cited by examiner

*Primary Examiner*—Vishu K. Mendiratta
(74) *Attorney, Agent, or Firm*—John J. Giblin; Bowles Rice McDavid Graff & Love LLP

(57) ABSTRACT

An automobile race game and method for playing same, is provided, comprised of a playing surface have printed on one side thereof a closed circuit race trace. The race track is divided across its width into parallel lanes. Each lane is divided into a sequence of spaces. A token is provided for each player set on a space on the race track. Players advance their tokens around the circuit according to the roll of three dice—two conventional dice and one supplemental dice. Some spaces are designated to "DRAW CARD," requiring player landing on such spaces to draw an event card from the top of an invented stack of event cards. The supplemental die has one face permitting lane change, and another multiplying the value of the other two dice. Players may change lanes only if they roll doubles, roll appropriately on the supplemental die, or draw an appropriate event card. The first player to complete a pre-determined number of laps or circuits of the race track is declared the winner.

6 Claims, 3 Drawing Sheets

42
16
20
22
12
10
42
DRAW CARD
DRAW CARD
DRAW CARD

LOW FUEL
TAKE PIT LANE

YELLOW FLAG
ROLL 1 DIE NEXT TURN

POWER BOOST
ROLL AGAIN

LANE CHANGE YOUR CHOICE
KEEP AND USE WHEN NEEDED

LANE CHANGE RIGHT

MOVE TO OUTSIDE LANE

LANE CHANGE YOUR CHOICE

LANE CHANGE LEFT

FREE PASS OF PIT ROAD
KEEP AND USE WHEN NEEDED

CLUTCH SLIP
NEXT TURN ROLL ONLY 1 DIE

FIG. 3

AUTO RACING BOARD GAME

FIELD OF THE INVENTION

The present invention relates to board games, particularly to an automobile racing board game which simulates many events and strategies present in the sport of automobile racing.

DESCRIPTION OF THE PRIOR ART

Board games have been a popular source of recreation and entertainment, for young and old alike, for many generations. Their popularity often comes from the competition uses, player interaction and strategy that are created by the rules of the games, while also providing further interest by attempting to simulate an area of interest from the real world.

One such gendre of board games is automobile racing. The sport of automobile racing, such as NASCAR® sanctioned races, is a popular spectator sport among many segments of the population. There is an interest among fans of this sport for board games which simulate these races. The prior art includes several examples for such board games.

Examples of automobile racing board games in the prior art include: U.S. Pat. No. 6,764,076, issued to Meritt on Jul. 20, 2004; U.S. Pat. No. 6,464,223, issued to Rutter on Oct. 15, 2002; U.S. Pat. No. 6,095,522, issued to Spell, et al. on Aug. 1, 2000; and U.S. Pat. No. 5,934,673, issued to Telarico, et al. on Aug. 10, 1999.

Each of these examples share a game board or playing surface, upon which is printed a multi-lane closed circuit track. Each lane is divided into a number of move spaces. Tokes are selected by each player, typically in the form of a miniature or toy race car, and are placed on a move space in the race track to indicate a player's position in the race simulation.

Players, in turn, advance around the track. The extent of advance during any single turn is determined usually by a random number generation means, typically a pair of dice. The players, in turn, role the dice and advance around the race track. The goal usually is to be the first player to complete a pre-determined number of laps or circuits around the race track.

To add interest beyond just the simple roll of the dice, games often incorporate events which can alter or effect the simple value of the dice roll. These may include; for example, losing a turn or advancing or retreating and extra number or multiple of spaces. These altering events may be printed on a random selection of move spaces, so that the event applies if a player lands on that indicated space or the last space of his move based on the roll of the dice. Alternatively, these events may be printed on a number of draw cards, which are stacked, inverted on the board. Spaces in the lanes of the race track are labeled "DRAW CARD" or the like, which, upon landing on such spaces, the player draws the top card from the stack and follows the directive printed on the reverse side. This adds a degree of suspense to the game, as the player landing on a "DRAW CARD" space will not know beforehand whether the top card will be advantageous or disadvantageous.

These games further attempt to simulate real-world automobile races by simulating common tactics in these races, such as passing and blocking. These are implemented in the board games by permitting, but controlling the ability for a player to change lanes and pass other players' tokens. By changing lanes, a player can move to an inside lane, which, in many of the examples in the prior art, have fewer spaces to complete one circuit or lap of the track. Thus, a player moving primarily within the inner lanes has a greater chance of winning. However, if several players occupy one or two of the most interior lanes, the lead players have the opportunity to block trailing players from progressing directly beyond them, and forcing the trailing players to attempt to pass by moving to a more exterior. Thus, the implementation and control of the ability to change lanes is crucial to the interest generated in the game.

Most of the examples in the prior art further attempt to simulate real-world automobile racing by including a "pit lane" on the board, into which a player may be diverted by landing on a designating space or drawing a designating card. The pit lane simulates the time lost during repair, maintenance and refueling which are always necessary during an actual race. When in the pit lane, a player's forward progress is typically encumbered by some means, such as restricting the player in the pit lane to use only half the usual number of dice for their turn.

While these games simulate a real-world automobile race, improvements in the method of play of these games, which would increase the level of tactics available, especially in the control and restriction on passing other players, has been found desirable.

One objective of the present invention is to provide a board game and a method of entertainment which closely simulates an actual NASCAR® sanctioned automobile race.

Another objective is to provide a board game and a method of entertainment which simulates event tactics and strategies commonly encountered in actual automobile races.

Another objective is to provide a novel means for enabling but controlling the ability of a player in an automobile racing board game to pass or block other players in the same lane, in a way that adds interest and augments the available tactics of the game.

SUMMARY OF THE INVENTION

To improve on the prior art in the field of automobile racing board games, disclosed herein is a method for playing a board game which closely simulates a real-world automobile race, specifically one organized and operated under the rules of the National Association for Stock Car Racing, more commonly known under the acronym, NASCAR®.

A typical NASCAR® race involves a number of stock cars racing around a closed circuit track, the winner being designated as the first car to complete a specified number of laps of the closed circuit track. Because of the layout of the track, and that the cars race around in a counter-clockwise direction, there are more bends to the left than to the right. The distance around one circuit of the track is thus shorter on the left-side than the right-side of the track. This characteristic creates the need for unique tactics, including blocking a trailing car and passing a leading car. The eventual needs for repair, maintenances and refueling in the pit area must also be considered in the racing strategy.

The improved NASCAR®-type automobile race is simulated in the present invention by first providing a playing surface. Printed on the playing surface is a closed circuit race track. The track is dividing into a number of lanes. Each lane is divided into a number of move spaces. The number of spaces in the inner lane is less than that of the outer lane, and the number in each of the intermediary lanes between the inner and outer lanes is proportional between the two.

Each player selects a token to represent their position on the race track, typically a toy or model stock racking car. Before the game begins, the number of lanes to finish the race is decided upon.

Three dice are provided for the players to effectuate their motion around the track. Two of the dice are typical dice, with between one and six spots imprinted on each of the six faces of the die. A third, supplemental die is provided. Four faces of the supplemental die are blank, and have no effect if rolled. A fifth face of the supplemental die is imprinted with an indicia indicating an augmentation, such as "double" or "X2 " or the like of the value of the other two conventional dice. The sixth face is imprinted with "PASS" or the like, indicating that the player may change lanes as part of that roll.

A number of spaces in each lane, distributed randomly around the circuit of the track, are designated as "DRAW CARD" spaces. A stack of draw cards are provided, the top card from the stack of which is taken by a player landing on a "DRAW CARD" space. The draw card will direct an alteration, either advantageously or disadvantageously, to the player's move. The directives on the cards include losing a turn, advancing or retreating some number of spaces, or to proceed to the pit lane. Directives allowing the player to change lanes are also provided.

The inner lanes have more designated "DRAW CARD" spaces than the outer lanes, making travel in the inner lanes riskier.

The game begins by each player rolling the two conventional dice to determine roll position. The player with the highest roll is assigned to the inside lane at the start/finish line, and so on outward with progressively lower rolls.

The game continues by each player, in turn, rolling the three dice, including the supplemental die. If one of the four blank faces on the supplemental die turns up, the player merely moves the number shown on the other two conventional dice. If the "X2" face rolls up on the supplemental die, the player may move a number of spaces equal to double that shown on the two conventional dice. If the "PASS" face rolls up in the supplemental die, the player may change lanes, either inward or outward, during the course of his move. If a player lands on a "Draw Card" space, the player selects the top card from the draw stack and follows the directions thereon.

A pit lane is also provided, which cuts across the interior, or "infield" of the race track. While traveling in the pit lane, a player may only roll one conventional die for his or her move, thus simulating the delay caused by typical pit stops in an actual NASCAR® race.

While circulating the track, a player will normally desire to move to the inside, or left lane, where fewer spaces are present to complete a circuit or lap. However, by the method of this game, a player cannot jump over another token in front in the same lane. If a player reaches a space immediately behind a preceding token of another player, then that player's turn ends there at that space. To proceed around and in front of another player, the lagging player must change lanes with his token and pass the leading player's token. However, a player can change lanes with his token only if a "PASS" or the like is rolled on the supplemental die, or if a draw card is selected with permits a lane change or if the player had rolled "double" on the pair of conventional dice. This need to change lanes and pass to gain the lead in the race, plus the limited availability for changing lanes, produces interest and strategy in the courts of the game play.

These and other objectives and advantages of the invention will become apparent from the description which follows. In the description, reference is made to the accompanying drawings, which from a part hereof, and in which is shown by way of illustration specific embodiments in which the invention may be protected. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

DESCRIPTION OF THE DRAWINGS

FIG. 3 is an illustration of examples of event cards.

DETAILED DESCRIPTION OF THE PREFERRED EMBODIMENT

The following discussion describes in detail one or more embodiments of the invention. The discussion should not be construed, however, as limiting the invention to those particular embodiments, and practitioners skilled in the art will recognize numerous other embodiments as well. The complete scope of the invention is defined in the claims appended hereto.

Figure 1:
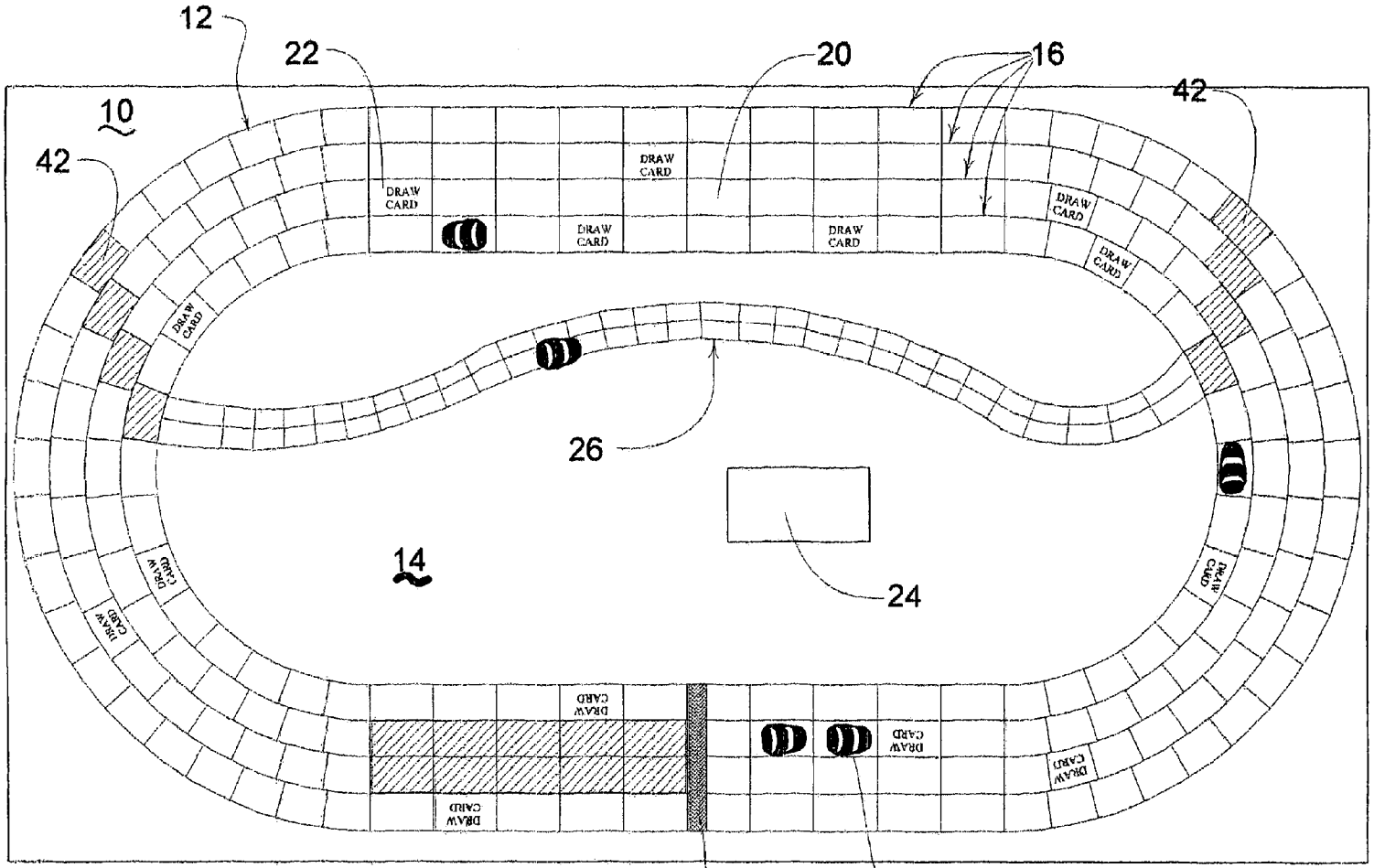
FIG. 1 is an illustration of a playing surface printed with multi-lane closed circuit race track used in the invention.

An improved automobile racing game is comprised in part, of a playing surface 10 as shown in FIG. 1. The playing surface 10 may be manufactured of a compressed cardboard material commonly known in the art and board game industry or, as in the preferred embodiment, manufactured of a flexible polymeric sheet which can be rolled and conveniently stored and unrolled to provide a flat playing surface.

Imprinted on one side of the playing surface 10 is a race track 12. The race track 12 is a closed circuit, forming a continuous path around the playing surface 10. The closed circuit of the race track 12 defines an infield 14 within the area enclosed by the race track 12. A start/finish line 18 is indicated across the width of the race track 12, preferably disposed near the center of the width of the playing surface 10.

The race track 12 is divided equally across its width into a plurality of lanes 16. Preferably, the number of lanes is four or five.

Each lane 16 is circumferentially divided into a plurality of move spaces 20. Preferably, each move space 20 in an individual lane 16 is the same length. The number of move spaces 20 may be equal to, but preferably greater than the number of move spaces 20 in the interior adjacent lane 16. Thus, an exterior lane 16 has more move spaces 20 around the circuit of the race track 12 than an interior lane 16.

Traversing across the infield 14 is a pit lane 26. The pit lane 26 is similarly divided into a plurality of spaces along its length. The two spaces at either end of the pit lane 26 are adjacent to spaces in the most interior lane 16 of the race trace 12. In one embodiment, the pit lane 26 is comprised of a single lane, while in another embodiment; the pit lane 26 is divided longitudinally into two lanes. This second embodiment enables various passing strategies within the pit lane 26.

Disposed randomly around the circuit of each lane 16 are one or more spaces labeled "DRAW CARD" or the like. In the preferred embodiment, the most exterior lane 16 has only one "DRAW CARD" space 22, while each subsequent interior lane 16 has a greater number of "DRAW CARD" spaces 22.

Disposed within the infield 14 of the race track 12 is an event card stack 24, comprised of a plurality of event cards 28, described below.

The object of this automobile racing game is to simulate a plurality of players racing around the race track 12. To enable this simulation, each player is assigned a token 40 to represent that player's position on the race track 12. The tokens are preferably miniature or toy race cars to replicate actual NASCAR® race cars. Each token 40 has an indicia in the form of a numeral to enable distinguish each player's token 40.

At the start of each game, the number of laps around the circuit of the race track 12 which will determine the winner of the game is decided. The player's then place their tokens into the race track 12 behind the start/finish line 18, according to a determination of pole position, the players then proceed around the circuit of the race track 12, in turn, until one player completes the pre-determined number of circuits, and is declared the winner of the race.

Figure 2:
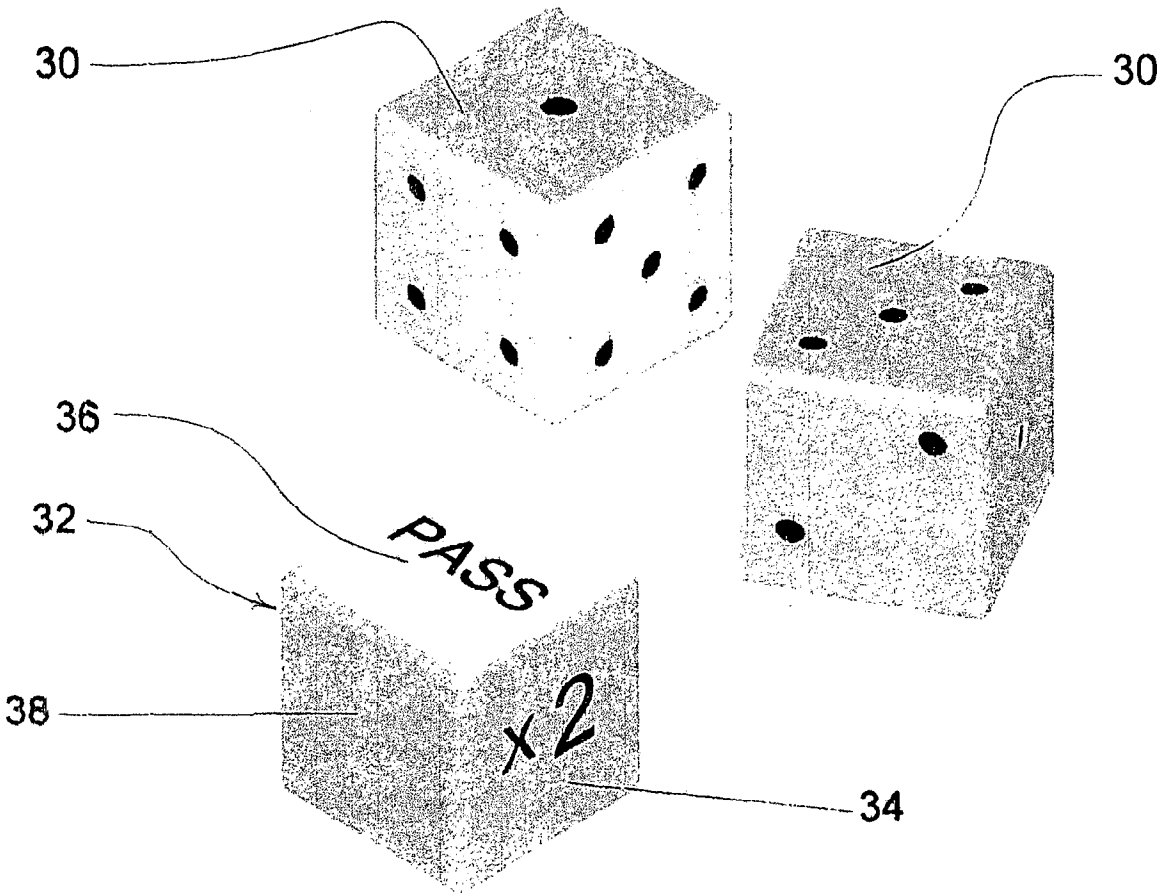
FIG. 2 is an illustration of a pair of conventional dice and the supplemental die.

The pole position of each player at the start of race, as well as the number of move spaces 20 traversed during each player's turn, is determined by a random number generator, such as a pair of dice 30 shown in FIG. 2. The dice are typical of those commonly used in the gaming industry, comprising a cube with six faces, each face having from one to six spots denoting the numeric values of one through six.

Each player rolls the pair of dice 30 to determine his (or her) pole position behind the start/finish line 18. The player with the highest combined value of the two dice places his token 40 with the first pole position, which in the preferred embodiment, is on the first space immediately behind the start/finish line 18 in the second most interior lane 16. The player with the next highest will place his token 40 in the second pole position in the move space 20 immediately behind the start/finish line 18, exteriorly adjacent to the first pole position. Each subsequent odd-numbered pole position is located behind the preceding odd-numbered pole-position, and each subsequent even-numbered pole position is located behind the preceding even-numbered pole position.

To circuit the race track 12, each player rolls the pair of dice 30, as used above for determining pole position, plus one additional supplemental die 32. As shown in FIG. 2, the supplemental die 32 is a cube with six equal faces. In the preferred embodiment, four of the faces are blank. One face of the supplemental die 32 has some indicia, such as "X2" 34 or the like, indicating that the value of the roll of the pair of dice is to be doubled for that turn. Other multiples may be implemented.

The sixth face of the supplemental die 32 has an indicia, "PASS" 36 or the like, directing that a lane change during that turn is permissible.

Each player, in turn of their original roll position, rolls the pair of dice 30 and the supplemental die 32. In the preferred embodiment, the three are rolled simultaneously. In another embodiment, the supplemental die 32 is rolled immediately subsequent to the roll of the pair of dice 30.

If a blank face 38 is rolled (meaning a blank face is facing upward when the rolled die comes to rest) on the supplemental die 32, then the player moves his token 40 forward a number of spaces equal to the combined value rolled by the pair of dice 30 (meaning the sum of the two values of the indicia of the upward facing faces of the two dice 30 when the dice come to rest after being rolled). The player must remain within the same lane 16, except as described below. If another token 40 is disposed in a space in the same lane 16 as the current turn's player's token 40, within the number of spaces as the current turn's rolled value, the advancement of the current turn's player's token 40 ceases in the space immediately behind the preceding token 40.

If, when the supplemental die 32 is rolled, the "X2" 34 face is rolled, the current turn's player must advance his token 40 a number of free spaces equal to twice the value of the rolled pair of dice 30. Again, unless as prescribed below, the current turn's player must cease advancement of his token 40 in the space immediately behind the preceding token 40 if that preceding token 40 is within the value of his roll.

Finally, if the "PASS" 34 indicia on the supplemental die 32 is rolled, the current-turn's player may move his token 40 into an adjacent lane 16, either to the interior or to the exterior of the track, while advancing his token 40 according to the value of the roll of the pair of dice 30. The player of the current turn who rolled "PASS" may optionally change lanes 16 regardless of the presence of another token 40 blocking advancement in the present lane 16.

As noted previously, one or more spaces in each lane 16 are marked as "DRAW CARD" spaces 22. If a player's token 40, at the end of advancement during a turn, is on a "DRAW CARD" space 22, that player must select the top card of the stack of event cards 24. The event cards stack 24 is typically located on a designated area somewhere in the infield 14 of the race track 12.

As shown in FIG. 3, the event cards 28 are ordinary paper-stock cards, possibly laminated, having text or indicia on one side of the card, which directs or instructs some event which provides an additional advantage or disadvantage to the player's advancement.

The event cards 28 simulate events commonly occurring in automobile racing, which can improve or impair advancement of a player's token 40 around the race track 12. These may include, for example, "Spin Out—Roll 1 die next turn", "Engine Problems—Take Pit Lane", "Lane Change Left" or "Power Boost—Roll 1 Die Move Ahead This Turn". Some event cards 28 provide an advantage or disadvantage, without any direct correlation to actual automobile racing events. These may include, for example, "Move to Outside Lane" or "Lane Change Left". These type of event cards 28 add a degree of random chance into the play, thereby adding further interest and suspense to the game.

Some event cards 28 can be "banked" or held by the player without execution on the turn on which it was drawn. Examples of such event cards 28 include, "Lane Change, Your Choice—Keep and Use When Needed," or "Free Pass of Pit Road—Keep and Use When Needed". Each of these type cards may be held by a player past the turn on which it was drawn, and used subsequently when it may provide a more strategic advantage in the game.

The spaces marked "DRAW CARD" are distributed randomly around the circuit of a lane 16. However, the number of "DRAW CARD" spaces 22 in each lane 16 is not necessarily the same. Preferably, an interior lane 16 has more "DRAW CARD" spaces 22 than a more exterior lane 16. This provides a higher degree of risk, for either advantage or disadvantage, for traversing the circuit in the shorter, interior lanes 16. In one embodiment of the invention, the stack of event cards 24 have a greater proportion of disadvantageous event cards 28, or cards that impair advancement, rather than advantageous event cards 28, or cards that improve advancement of a player's token 40. Variations of the ratio of spaces in interior to exterior lanes 16, and of the ratio of disadvantageous to advantageous event cards 28 can vary the interest and suspense in selecting lane change strategies. Higher ratios in the number of spaces in exterior to interior lanes 16 suggest a strategy of going to an inside lane whenever possible, but a higher ratio of disadvantageous event cards 28 in the stack of event cards 24, along with a higher proportion of "DRAW CARD" spaces 22 in the interior lanes 16, may counterbalance that apparent advantage provided by the interior lanes 16.

As noted previously, a pit lane 26 traverses the infield 14, and has two ends, each end of which is adjacent to a space of the most interior lane 16 of the race track 12. Passage through the pit lane 26 is only one way; when a player must proceed through the pit lane 26 according to the rules, that player must move his token 40 only through the entry end of the pit lane 26, and proceed through to the exit end.

As shown in FIG. 1, a row of staggered spaces 42 precedes the entry of the pit lane 26, and follows the exit of the pit lane 26. These staggered spaces 42 are indicated on the playing surface 10 by a unique color, such as yellow, or by cross-hatching, or other indicia. If a player is directed to proceed to the pit lane 26, either by the draw of an event card 28, or as otherwise provided by the rules of the several embodiments, that player continues in his present lane 16 until he reaches the space in his lane 16 of the row of staggered spaces 42 leading to the pit row entrance. Once there, that player then follows the staggered spaces 42 across the interior lanes 16 of the race track 12, to the first space of the pit lane 26. The player proceeds through the pit lane 26 according to the game rules, and upon reaching the exit of the pit lane 26, proceeds in the row of staggered spaces 42, across the interior lanes 16 of the race track 12, until the player reaches the same lane 16 from which he originally began entry into the pit lane 26.

Progress around the race track 12 circuit is determined primarily by a random number generator, preferably a pair of dice 30, and further supplemented by a supplemental die 32, shown in FIG. 2. In the course of the game, each player, in turn as determined by the original pole position determination, rolls the pair of dice 30. The player moves his token 40 ahead in the same lane 16 a number of spaces equal to the value of the roll of the pair of dice 30. However, absent an allowance to change lanes 16, as described below, if another player's token 40 is in a space ahead of the current turn's player's token 40 within the number of spaces of the value of the dice roll, then the current player's advancement ends at the space immediately behind the space occupied by the preceding player's token 40.

Three exceptions exist to the preceding rule for remaining in one's lane 16. A player may change lanes 16 if: (1) he rolls a "doubles" with the pair of dice 30, i.e., the value rolled on both conventional dice are the same, (2) he draws an event card 28, directing or permitting a lane 16 change, after landing on a "DRAW CARD" space 22, or (3) he rolls a value of "PASS" 36 or the like on the supplemental die 32. Under any of these three circumstances, the player may move to an adjacent lane 16, either interior or exterior (unless otherwise specified in an event card 28) and then continue forward in the new lane 16. Only one lane 16 change may be accomplished per turn. When changing lanes 16, the player moves into the space adjacent to the back edge of the current space. This will usually result in a diagonal movement into the adjacent lane 16.

"Rolling doubles" carries a benefit, in addition to permitting a lane 16 change, of further permitting the current player to have another consecutive turn and roll again. The player rolls the pair of dice 30 and the supplemental die 32, and proceeds according to normal game rules. If the player "rolls doubles"a second consecutive time, he again "rolls again". He can also change lanes 16 a second time as a result of the second doubles. However, if he "rolls doubles" a third consecutive time, his turn ends and the turn passes to the next player in sequence. He cannot change lanes 16 due to the third consecutive "rolling doubles".

Changing lanes 16 can only be to a vacant space in the adjacent lane 16. If the space in the desired lane 16 adjacent to the back edge of the current space is occupied by another player's token 40, then a lane 16 change cannot be effectuated. The current player may, however, continue down his present lane 16, if not blocked by another token 40, and change lanes 16 into the adjacent lane 16 ahead of the other player's token 40 in the desired adjacent lane 16.

If a player rolls a "X2" 34 or the like on the supplemental die 32, then the value of the current roll is multiplied by factor of two, and the player moves his token 40 by that multiple value, but otherwise proceeding according to the same rules of the game.

If the value of the supplemental die 32 on a roll is one of the four blank faces 38, then the supplemental die 32 has no effect on the roll, and the player proceeds according to the normal rules of the game and the value rolled by the conventional pair of dice 30.

If a player rolls both doubles on the pair of dice 30, and a "PASS" 36 or the like on the supplemental die 32, then the player can effectuate two lane changes during the current move. Each separate lane change must be according to the rules set out above.

If a player has been directed to the pit lane 26 by an event card 28, the player continues in his current lane 16, without changing lanes, until the player reaches the staggered row of spaces across lanes leading to the entry of the pit lane 26. The player moves his token 40 along the staggered row of spaces, each space counting as one move like an ordinary move. After the player's token 40 has entered the pit lane 26, the player travels through the pit lane 26 by rolling only one conventional die 30 during each turn. Thus, a player in the pit lane 26 is limited to only a maximum of six spaces forward movement during a single turn.

In the preferred embodiment, the pit lane 26 is comprised of two adjacent lanes. This permits passing of another, slower token 40 further ahead in the pit lane 26. While in the pit lane 26, a following player's token 40 may pass a leading player's token 40 at will, since no other means are available for effectuating a lane change within the pit lane 26.

Once a player's token 40 passes the exit of the pit lane 26, the player proceeds along the row of staggered spaces 42 from the exit and returns to the same lane 16 in which he was traversing prior to proceeding to the pit lane 26. On the turn following exit from the pit lane 26, the player may again resume rolling all three dice.

In one embodiment of the present invention, one space within the pit lane 26 is labeled, "Fast Pit Stop" or the like. If a player's token 40 lands on this space, he is permitted to roll all three dice on his next turn, and only on his next turn while in the pit lane 26, and proceed according to the roll, as otherwise provided in the rules for the game.

Several circumstances may lead to a simulation of a crash on the race track 12. If a player lands on a "DRAW CARD" space 22 and draws an event card 28 that specifies "Lane Change Left" or the like, and is either in the most interior lane 16, or similarly draws an event card 28 specifying "Lane Change Right" and is in the most exterior lane 16, then a crash into the wall is simulated. That player places his token 40 off the race track 12 adjacent to the lane 16, and may then roll only one die on his next turn, as a penalty for the crash.

Likewise, if a player is directed to change lanes 16, either left or right, by an event card 28, and the resulting lane 16 change is into a space already occupied by another player's token 40, then both players are deemed to have been involved in a crash. Both players place their tokens 40 on the infield 14 adjacent to the space where the crash occurred, and on their next rolls, can only use one ordinary die on the next roll to return to the race track 12.

The players continue travel around the circuit of the race track 12, according to the above delineated rules, until one player completes the pre-designated number of laps and is designated the winner. In another embodiment of the invention, all players continue play until completing the pre-designated number of laps. The first to complete the laps is designated the first-place winner, the second the second-place winner, and so on.

To simulate a typical NASCAR® race series, each winning place may be awarded various point values, the first-place winner receiving the most points for that race, and lower amounts of points for each subsequent place finishing. The players may subsequently play further races, cumulatively summing the winner point values from each race for each player. The winner of the series is the player with the most cumulative points after completing the pre-designated number of races in the series.

While various embodiments of the invention have been described above, it should be understood that they have been presented by way of example, and not limitation. It will be apparent to persons skilled in the relevant art that various changes in form and detail may be made therein without departing from the spirit, and scope and application of the invention. This is especially true in light of technology and terms within the relevant art that may be later developed. Thus, the present invention should not be limited by any of the above-described exemplary embodiments, but should only be defined in accordance with the appended claims and their equivalents.

I claim:

1. A method for an auto racing board game for a plurality of players, comprising:

a) providing a playing surface, said playing surface imprinted with indicia representing a closed circuit race track, said race track divided into a plurality of lanes, said lanes divided into a plurality of move spaces, wherein one or more of the spaces are marked with indicia directing selection of an event card, said event card providing an advantageous or disadvantageous modification to a player;

b) providing a random number generator usable by the players to produce a random number value;

c) providing supplemental die, said supplemental die having six faces, four of said six faces being blank, one of said six faces marked with indicia permitting a lane change, and on one of said faces marked with indicia directing the augmentation of the random number value by a multiple;

d) providing a plurality of event cards, some of which permit moving a token to an adjacent lane;

e) providing a token for each player representing that player's position within a move space on the playing surface;

f) generating a random number value using the random number generator together with casting the supplemental die by one of the plurality of players;

g) moving the token of the player around the track within the lane according to the value of the random number value and, optionally, moving the token to an adjacent lane if permitted by the cast indicia on the supplemental die or augmenting the random number value by the multiple; and h) repeating steps (f) and (g) by each of the plurality of players, in turn, until a first player completes a predetermined number of laps around the race track.

2. The method of claim 1, wherein the random number generator is comprised of a pair of dice, wherein each die has six faces, each face having an indicia of a value from one to six.

3. The method of claim 2, wherein the player may permissibly move into an unoccupied space in an adjacent lane if the indicia of value indicated on each of the two dice are equal.

4. The method of claim 1, wherein the player may also permissibly move into an unoccupied space in an adjacent lane if permitted by a drawn event card.

5. The method of claim 1, wherein the playing surface further comprises a pit lane imprinted thereon, traversing across the interior of the race track, said pit lane divided into a sequential plurality of move spaces, said pit lane having two ends, each end disposed adjacent to a move space in the most interior lane of the race track, and further providing at least one event card in the stack of event cards directing a player to proceed through the pit lane.

6. The method of claim 1 further comprised of optionally moving a player's token to an adjacent lane upon or after drawing an event card so permitting.

* * * * *